US007600855B2

(12) United States Patent
Yagi et al.

(10) Patent No.: US 7,600,855 B2
(45) Date of Patent: Oct. 13, 2009

(54) LIQUID DROPLET EJECTING HEAD BAR, LIQUID DROPLET EJECTING DEVICE, AND LIQUID DROPLET EJECTING HEAD BAR MANUFACTURING METHOD

(75) Inventors: Takashi Yagi, Ebina (JP); Shinji Seto, Ebina (JP); Tadashi Suzuki, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 226 days.

(21) Appl. No.: 11/220,344

(22) Filed: Sep. 6, 2005

(65) Prior Publication Data

US 2006/0214986 A1 Sep. 28, 2006

(30) Foreign Application Priority Data

Mar. 24, 2005 (JP) ..... 2005-087205

(51) Int. Cl.
*B41J 2/14* (2006.01)

(52) U.S. Cl. ..... 347/49; 347/42

(58) Field of Classification Search ..... 347/42, 347/49, 8

See application file for complete search history.

(56) References Cited

U.S. PATENT DOCUMENTS

| | | | | |
|---|---|---|---|---|
| 5,565,900 | A * | 10/1996 | Cowger et al. | 347/42 |
| 5,771,052 | A * | 6/1998 | Hine et al. | 347/42 |
| 6,834,933 | B2 * | 12/2004 | Silverbrook et al. | 347/42 |
| 2004/0095422 | A1 * | 5/2004 | Eguchi et al. | 347/42 |
| 2006/0279607 | A1 * | 12/2006 | Silverbrook et al. | 347/49 |

FOREIGN PATENT DOCUMENTS

| | | |
|---|---|---|
| JP | 7-241991 | 9/1995 |
| JP | 2000-190501 | 7/2000 |

* cited by examiner

*Primary Examiner*—Matthew Luu
*Assistant Examiner*—Justin Seo
(74) *Attorney, Agent, or Firm*—Fildes & Outland, P.C.

(57) ABSTRACT

A liquid droplet ejecting head bar comprising: multiple liquid droplet ejecting head units that eject liquid droplets from nozzles; a long substrate on which the plurality of liquid droplet ejecting head units are arranged; and spacer components to which the liquid droplet ejecting head units are joined and fixed and which are attached to the long substrate so as to be removable.

14 Claims, 16 Drawing Sheets

LIQUID DROPLET EJECTING HEAD BAR, LIQUID DROPLET EJECTING DEVICE, AND LIQUID DROPLET EJECTING HEAD BAR MANUFACTURING METHOD

CROSS-REFERENCE TO RELATED APPLICATIONS

This application claims priority under 35 USC 119 from Japanese Patent Application No. 2005-87205, the disclosure of which is incorporated by reference herein.

BACKGROUND OF THE INVENTION

1. Field of the Invention

The present invention relates to a liquid droplet ejecting head bar on which multiple liquid droplet ejecting head units having multiple nozzles that eject liquid droplets are arrayed, to a liquid droplet ejecting device provided with this liquid droplet ejecting bar, and to a method of manufacturing the liquid droplet ejecting head bar.

2. Description of the Related Art

Among the inkjet recording devices that function as liquid droplet ejecting devices, there are those that are configured to have multiple inkjet recording head units (hereafter referred to as "head unit(s)") in which nozzles are formed such that a plurality of the units are aligned in the widthwise direction of the paper and fixed, thus providing a long ink ejecting head. Examples of such technologies are disclosed in the Official Gazettes of Japanese Patent Application Laid-Open (JP-A) No. 7-241991 and No. 2000-190501. The methods disclosed in these publications for lining multiple head units and fixing them involve adhering individual head units to a base plate, and employing a method where the spaces or gaps between the adjoining head units are filled with an adhesive.

Nonetheless, fixing the head units with the above methods means that the head units cannot be removed from the base plate. Accordingly, when, for example, one of the head units breaks or when it has been discovered during inspection that only one head unit is ejecting faultily, the entire long liquid ejecting head must be replaced. The other regularly functioning head units are needlessly disposed of, thus raising costs.

SUMMARY OF THE INVENTION

In light of the above-described problems, the present invention provides a liquid droplet ejecting head bar in which components can be exchanged and in which positioning between the liquid droplet ejecting head units can be performed with accuracy. The present invention also provides a manufacturing method for this liquid droplet ejecting head bar and a liquid droplet ejecting device provided with this liquid droplet ejecting head bar.

The liquid droplet ejecting head bar of the first aspect comprises: a plurality of liquid droplet ejecting head units that eject liquid droplets from nozzles; a long substrate on which the plurality of liquid droplet ejecting head units are arranged; spacer components to which the liquid droplet ejecting head units are joined and fixed and which are attached to the long substrate so as to be removable.

The liquid droplet ejecting head bar of the present aspect comprises a long substrate on which multiple liquid droplet ejecting head units are arranged. Spacer components are removably attached to the long substrate and liquid droplet ejecting head units are joined and fixed to the spacer components.

With the present aspect, the spacer components can be removed from the long substrate, whereby the liquid droplet ejecting head units can be removed making exchange of these units possible.

Further, with the invention of the present aspect, the liquid droplet ejecting head units are joined and fixed to the spacer components so the liquid droplet ejecting head units and the spacer components are not easily separated. Nonetheless, when compared to when these are attached with an attaching means such as screw clamps, the positioning with the adjoining liquid droplet ejecting head units becomes easier and these can be arranged with a high degree of accuracy.

The liquid droplet ejecting device of the second aspect has a liquid droplet ejecting head bar that comprises: multiple liquid droplet ejecting head units that eject liquid droplets from nozzles; a long substrate on which the multiple liquid droplet ejecting head units are arranged; spacer components to which the liquid droplet ejecting head units are joined and fixed and which are attached to the long substrate so as to be removable.

With the liquid droplet ejecting device of the invention of the present embodiment, the liquid droplet ejecting head units can be separated from the long substrate so the liquid droplet ejecting head units can be exchanged. Accordingly, when (a) liquid droplet ejecting head unit(s) breaks or malfunctions, it is not necessary to replace the entire liquid droplet ejecting head bar of the long substrate. This has advantages, for example, for users, who can reduce their printing device maintenance costs. Further, in the inspection process during manufacturing, even if a faulty liquid droplet ejecting head unit within the liquid droplet ejecting head bar is detected, this can be exchanged, whereby manufacturing costs can also be reduced.

The liquid droplet ejecting head bar manufacturing method of the third aspect of the present invention is a method involving attaching spacer components to a long substrate such that they are removable. Multiple liquid droplet ejecting head units that eject liquid droplets from nozzles are positioned and joined to the spacer components attached to the long substrate.

Since highly precise positioning is necessary for the liquid droplet ejecting head units, it is difficult to attach these with screws. However, it is not necessary to position the spacer components with the same degree of precision so even if there are slight deviations at the time of attachment to the long substrate, this is permissible, especially with deviations in the surface direction. With the liquid droplet ejecting head bar manufacturing method of the present invention, the spacer components are first attached to the long substrate so as to be removable, after which the liquid droplet ejecting head units are positioned and joined with the spacer components. By manufacturing with this process, exchange of each of the individual liquid droplet ejecting head units and highly precise joining of the components can be achieved.

DETAILED DESCRIPTION OF THE INVENTION

Figure 1:
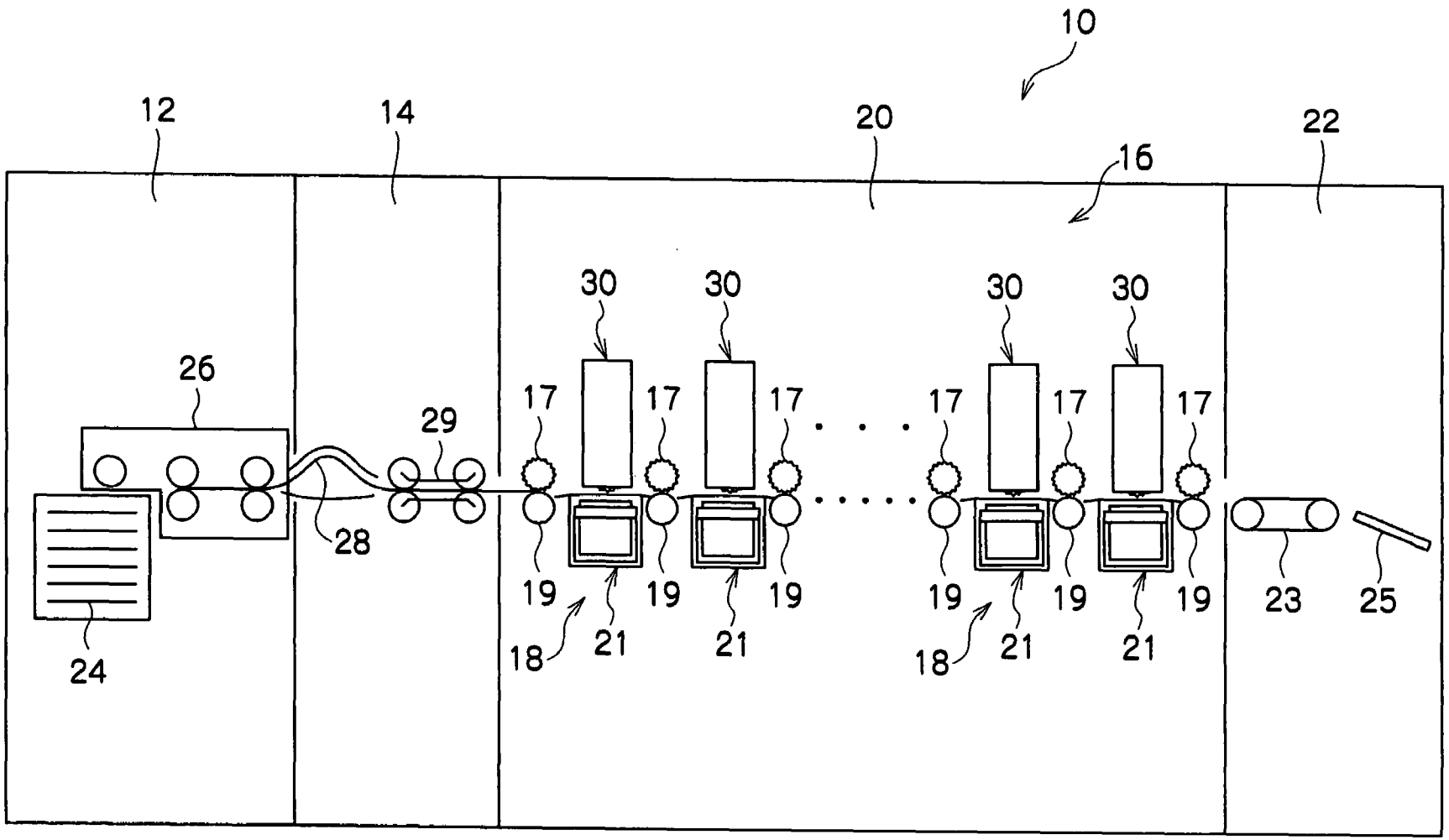
FIG. 1 is a schematic diagram showing the overall structure of an inkjet recording device of the present embodiment.

As shown in FIG. 1, an inkjet recording device 10 basically comprises a paper-supplying unit 12 that sends out paper; an adjustment unit 14 that controls the approach of the paper; a recording unit 20 provided with a recording head unit 16 that ejects ink droplets and forms an image on the paper and a maintenance unit 18 that performs maintenance of the recording head unit 16; and a discharging unit 22 that discharges the paper on which an image was formed at the recording unit 20.

The paper-supplying unit 12 comprises a stocker 24 in which stacked paper is stocked and a conveying device 26 that sheet-feeds paper from the stocker 24 one sheet at a time and conveys it to the adjustment unit 14.

The adjustment unit 14 is provided with a loop-forming unit 28 and a guide component 29 that guides the approach of the paper. By passing through this portion, the body of the paper is used to correct skew, the conveying timing is corrected, and the paper approaches the recording unit 20.

The exiting unit 22 passes paper on which an image was formed at the recording unit 20 through a paper-exit belt 23 and stores it on a tray 25.

A paper-conveying route on which recording paper is conveyed is formed between the recording head unit 16 and maintenance unit 18. Recording paper P is continuously sandwiched and held (without stopping) by star wheels 17 and conveying rollers 19. Then ink droplets are ejected from the recording head unit 16 onto this paper and an image is formed on the appropriate recording paper.

The maintenance unit 18 comprises a maintenance device 21 arranged facing a recording head unit 32. The maintenance device 21 can perform maintenance processing such as wiping, dummy jet, and vacuum processing.

Figure 2:
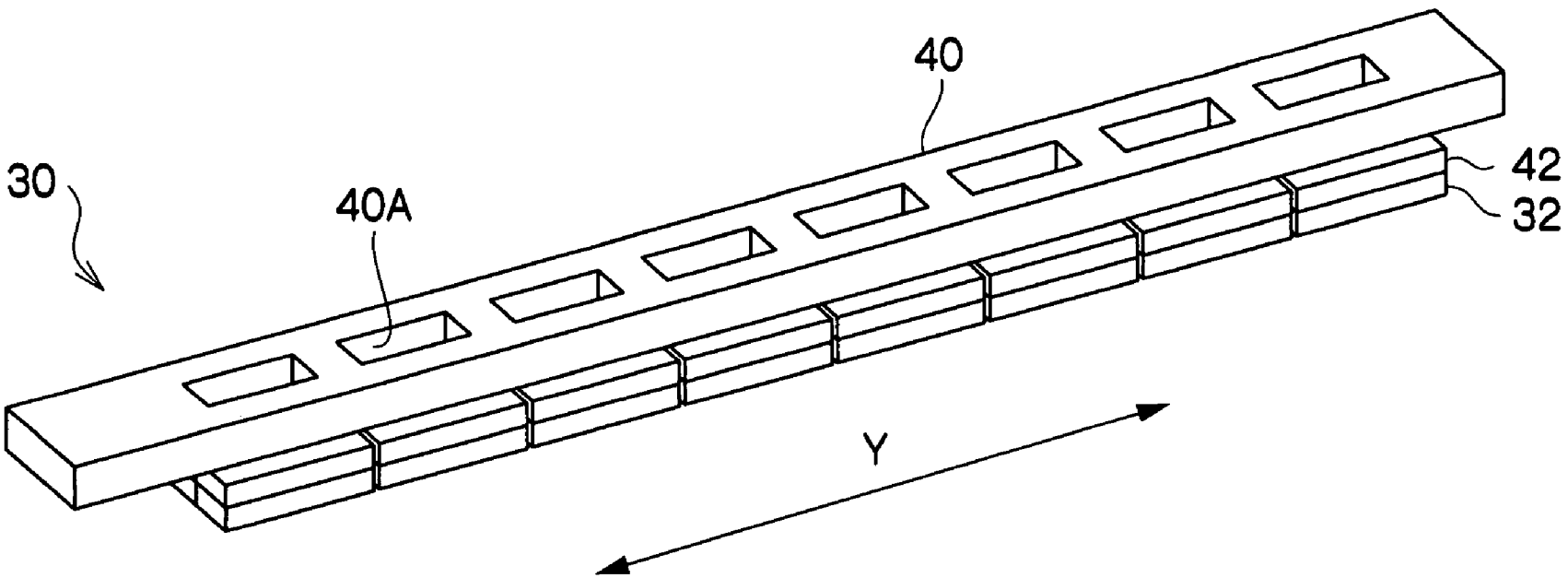
FIG. 2 is a perspective view of an inkjet recording head bar of the present embodiment.
Figure 3A:
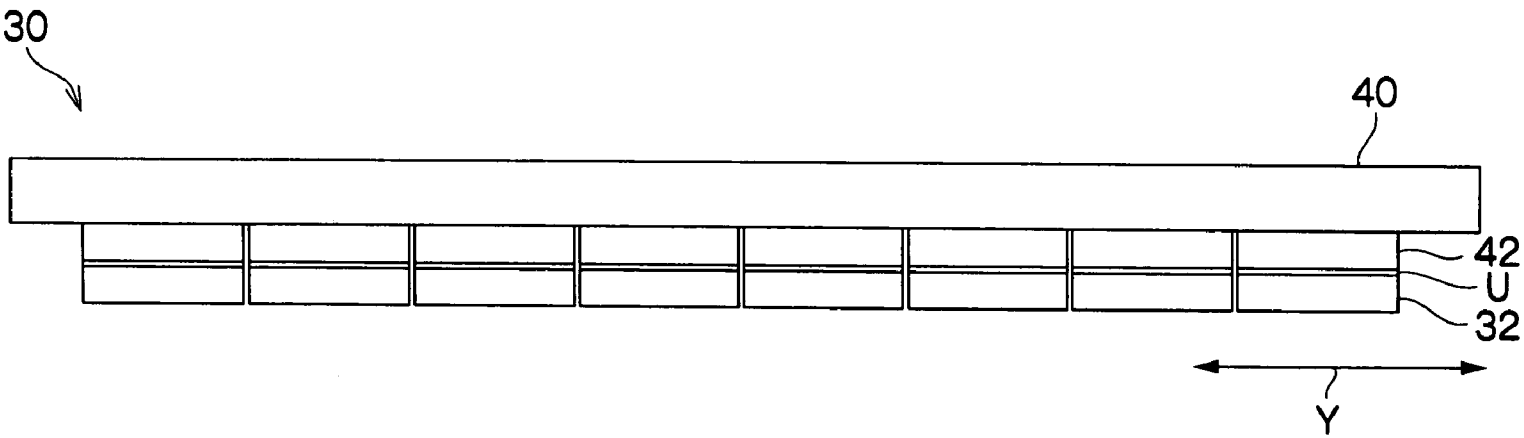
FIG. 3A is a side surface diagram of the inkjet recording head bar of the present embodiment.
Figure 3B:
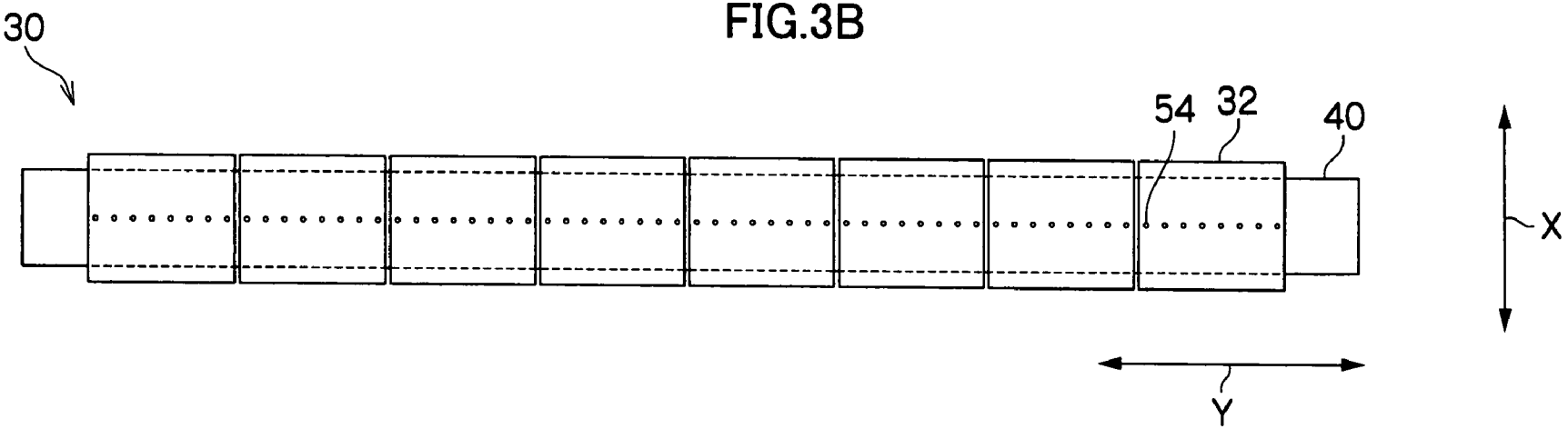
FIG. 3B is a bottom surface diagram of the inkjet recording head bar of the present embodiment.

As shown in FIGS. 2, 3A, and 3B, an inkjet recording head bar 30 is provided with multiple recording head units 32 arranged in the paper sending direction X and the direction perpendicular thereto (i.e., paper width direction Y). As shown in FIG. 3B, multiple nozzles 54 are formed in a line in the paper widthwise direction Y at the recording head unit 32. An image is recorded on the recording paper P by the ejecting of ink droplets from the nozzles 54 on the recording paper conveyed continuously along the paper-conveying route. It should be noted that the inkjet recording head bar 30 has at least four colors corresponding to each color of YMCK for recording, for example, what is known as full-color images. Details on the inkjet recording head bar 30 will be given later.

Figure 4:
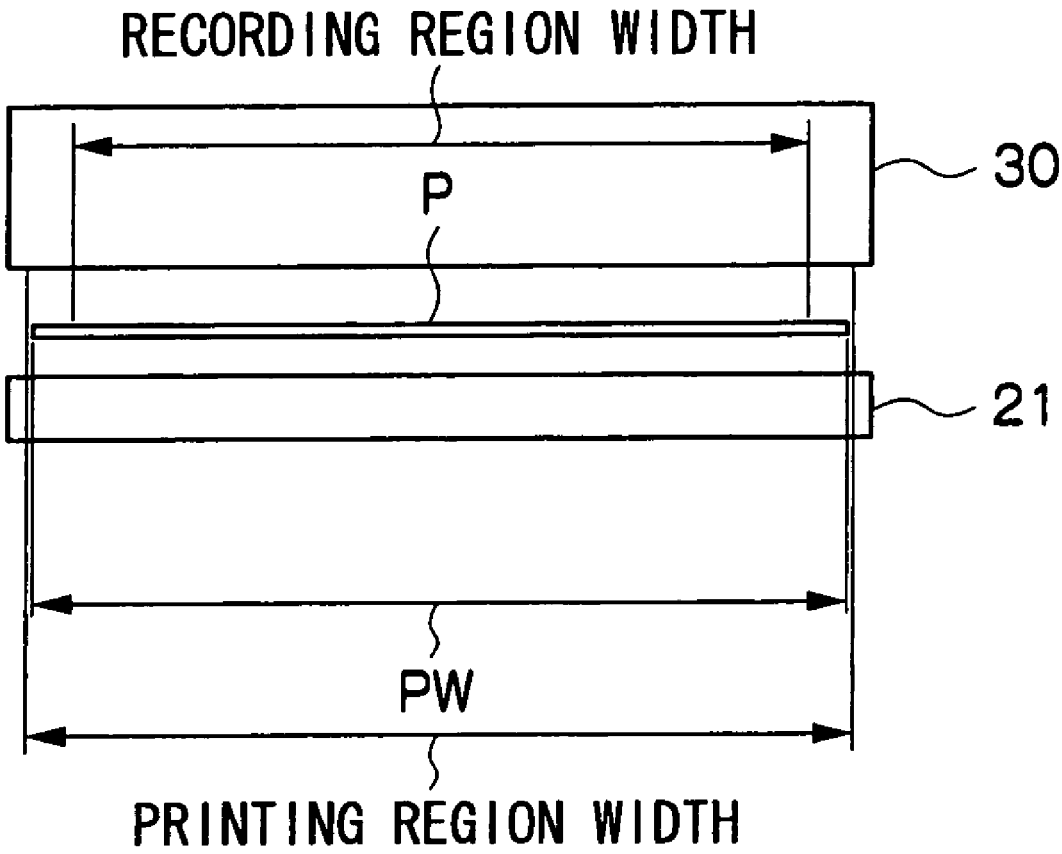
FIG. 4 is a diagram showing the printing region of the inkjet recording head bar of the present embodiment.

As shown in FIG. 4, the printing region width by the nozzles 54 of each of the inkjet recording head bars 30 is made to be longer than the greatest paper width PW of the recording paper P onto which it is assumed that image recording with this inkjet recording device 10 will be performed. Image recording is possible across the entire width of the recording paper P without moving the inkjet recording head bar 30 in the paper widthwise direction Y (i.e., full width array (FWA) printing is possible). Here, the basis of the printing region are the largest areas inside the recording region from which the margins, which are not printed, from both ends of the paper are excluded, but this is generally larger than the largest paper width PW that is printed. This is due to the fact that there is a danger of the paper inclining from the preset angle relative to the conveying direction (i.e., skewing) and also there is a great demand for no-edge printing.

Next, detailed explanations will be given regarding the inkjet recording head bar 30.

As shown in FIGS. 2, 3A, and 3B, the inkjet recording head bar 30 is configured to comprise a long substrate 40, multiple recording head units 32, and multiple spacer components 42. The long substrate 40 extends in the paper widthwise direction Y and multiple openings 40A are formed therein. The width of the paper sending direction X of the long substrate 40 is narrower than the widthwise direction of the recording head unit 32. Due to this, the inkjet recording head bar 30 can be made to be compact.

Figure 5:
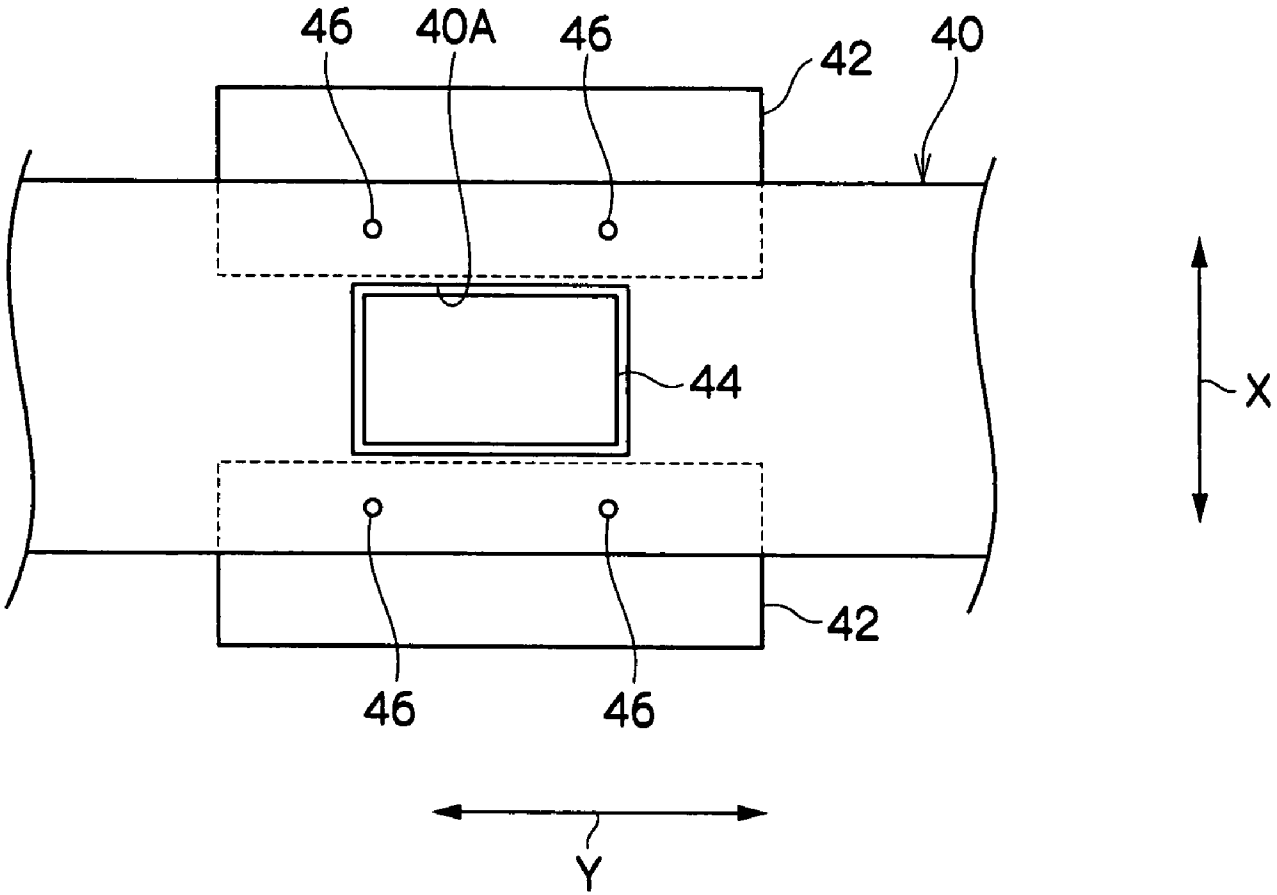
FIG. 5 is an upper surface diagram showing the structure of the attaching portion of the spacer component of the inkjet recording head bar of the present embodiment.
Figure 6B:
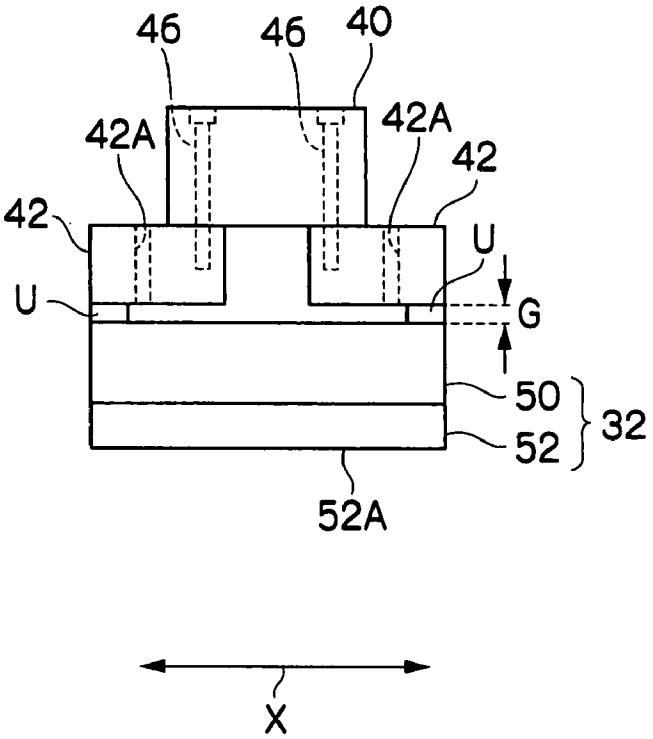
FIG. 6B is an another side surface diagram showing the structure of the attaching portion of the recording head unit of the inkjet recording head bar of the present embodiment.
Figure 6A:
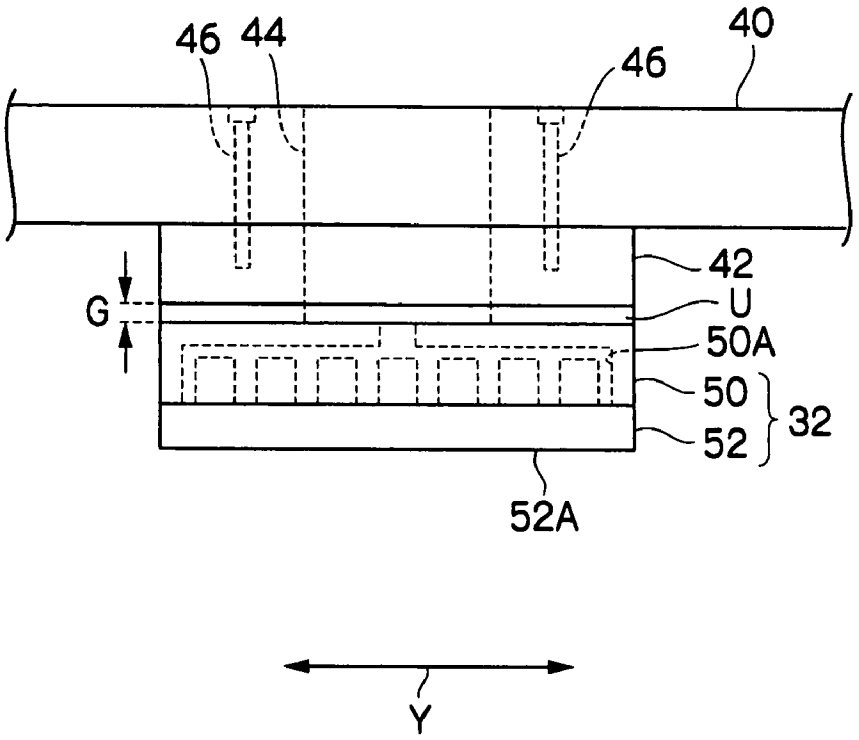
FIG. 6A is a side surface diagram showing the structure of the attaching portion of the recording head unit of the inkjet recording head bar of the present embodiment.
Figure 13:
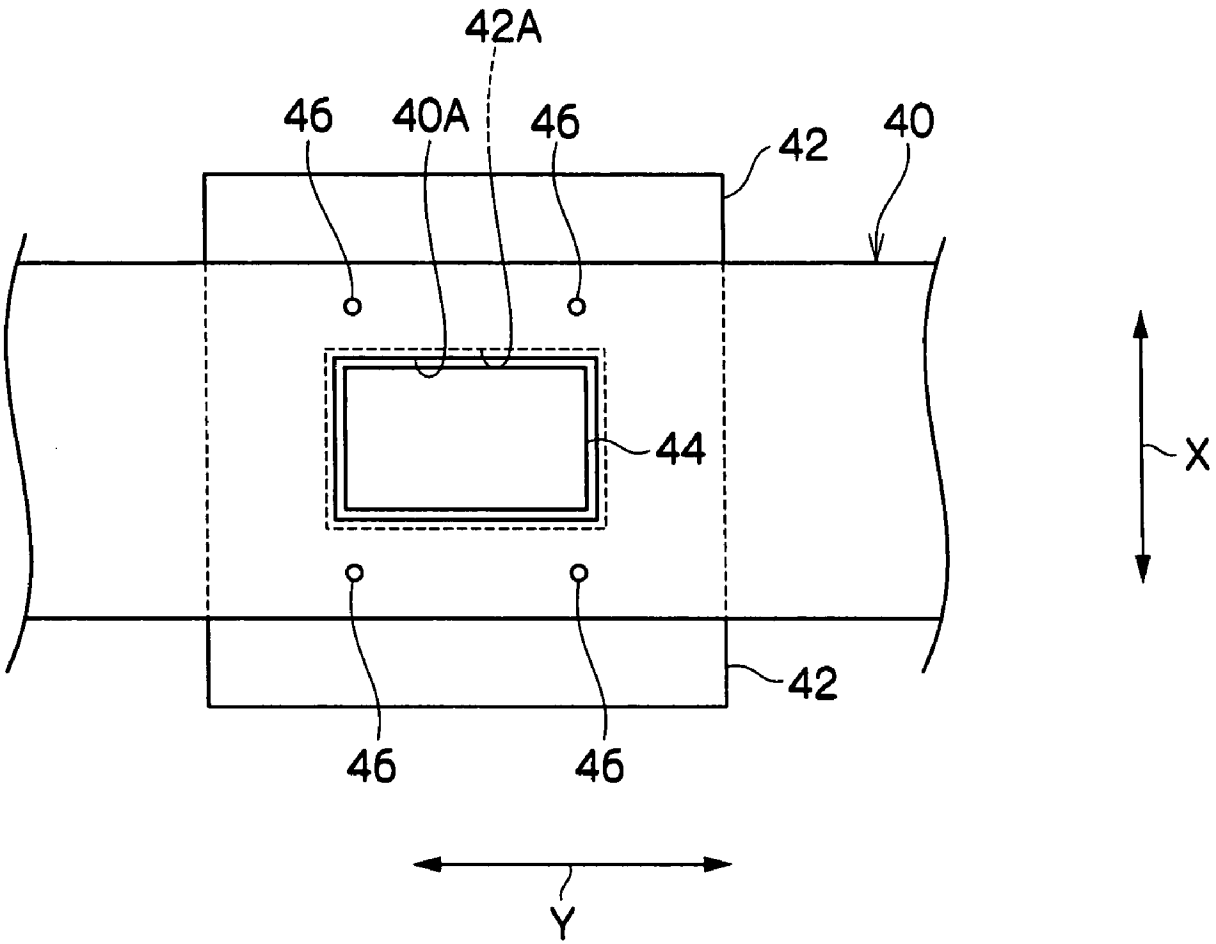
FIG. 13 is an upper surface diagram showing another structure of the attaching portion of the spacer component of the inkjet recording head bar of the present embodiment.

Spacer components 42 are attached to the bottom surface of the long substrate 40. The spacer components 42 are made to be board-shaped and, as shown in FIG. 5, are arranged two each per recording head unit 32 so as to be separated from each other in the paper sending direction X. As shown in FIGS. 6A and 6B, the spacer component 42 is screwed to the long substrate 40 in two places with screws 46. Due to this configuration, the spacer component 42 can be removed from the long substrate 40. An ink supplying unit 44 (see FIG. 5) is arranged between two spacer components 42 so as to supply ink from an ink tank (not shown) to the recording head unit 32. It is not necessary to supply a channel for supplying ink at the spacer component 42 itself since two spacer components 42 are arranged to be separate from each other. By arranging the ink supplying unit 44 in the portion separating the spacer components 42, an ink supply path can be ensured. Further, it is not necessary to form an ink supply path at the spacer component 42 and a material can be selected without considering the ink resistance thereof, whereby freedom of selection for the material used for the spacer component 42 can be obtained. Further, descriptions were given here regarding a case where two spacer components per recording head unit 32 are used separated from each other, however, the present invention is not limited thereto. For example, the above-described two spacer components 42 separated from each other can be made to be one spacer component. Further, the spacer components 42 can be arranged so as to not be in the portion where the ink supply path is arranged such that, for example, a through-hole 42A is formed in that one portion (see FIG. 13).

Figure 14:
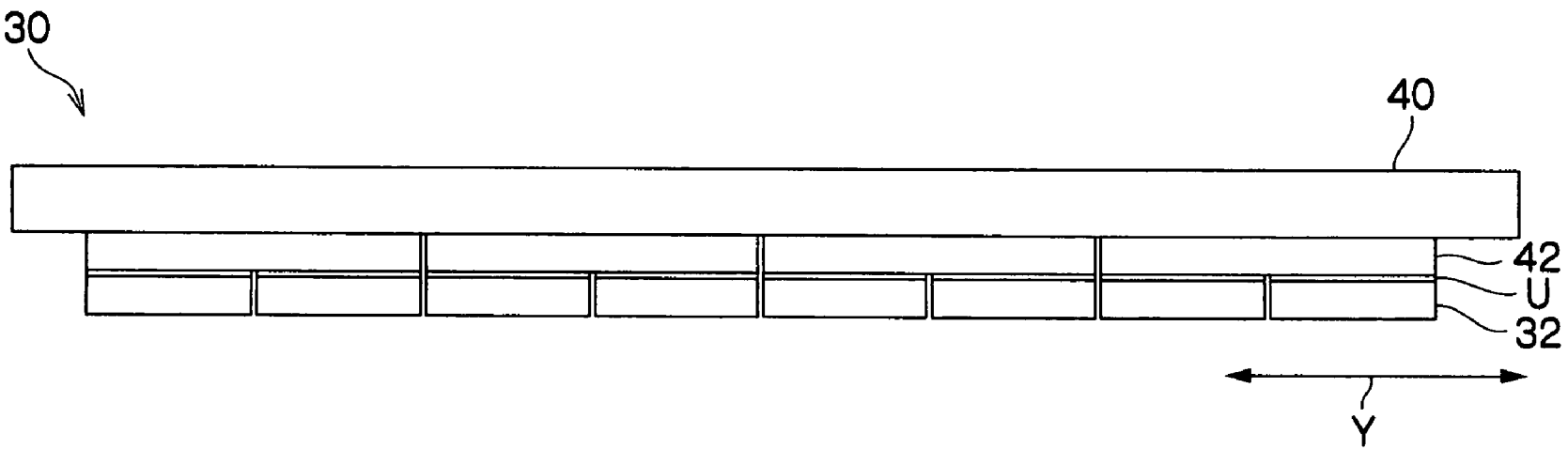
FIG. 14 is a diagram showing an alternative example of the spacer component of the inkjet recording head bar of the present embodiment.

Further, in the present embodiment, a spacer component 42 is used for each recording head unit 32, however, a spacer component 42 can be used per set of multiple recording head units 32 when necessary. In this case, the number of spacer components 42 used can be decreased and are exchangeable per set of multiple recording head units 32, so manufacturing costs can be reduced (see FIG. 14).

As shown in FIG. 6A, the recording head unit 32 comprises a liquid relay component 50 and a head substrate 52. The head substrate 52 is arranged at the ink ejecting side and the nozzles 54 that eject ink are formed in one line in the paper widthwise direction Y at the side of a nozzle surface 52A. Here, an example was raised where nozzles are formed in one line in the paper widthwise direction Y at the head substrate 52, however, the present invention is not thus limited. For example, the nozzles can be formed in a flat surface two-dimensional matrix pattern in the paper widthwise direction Y and the paper sending direction X in order to improve image quality and speed. Components such as a piezoelectric element, diaphragm, and pressure chamber are provided at the head substrate 52 in order to eject ink.

The liquid relay component 50 is arranged at the side of the spacer component 42, and a individual supply route 50A that is communicated with the ink supplying unit 44 and supplies ink to each nozzle 54 is formed at the liquid relay component 50.

The recording head unit 32 sandwiches the spacer component 42 and is arranged at the opposite side of the long substrate 40. When viewed from the side of the nozzle surface 52A, the edge periphery portions of the spacer component 42 and recording head unit 32 further to the outer side that the long substrate 40 following the paper widthwise direction Y appear to be almost exactly the same shape. The recording head unit 32 is joined and fixed to the spacer component 42 at both edge portions along the paper widthwise direction Y, that is, at both edge periphery portions along the longitudinal direction of the recording head unit 32. In the present embodiment, the joining and fixing of the recording head unit 32 and spacer component 42 is performed using an adhesive U and the adhesive U is applied between the recording head unit 32 and spacer component 42 at both of the aforementioned edge peripheries.

A gap G that is the thickness of the adhesive U is formed between the recording head unit 32 and the spacer component 42 and the heights of the nozzle surface 52A of multiple recording head units 32 can be made even by adjusting this gap G.

It should be noted that although an example was explained in the present embodiment where an adhesive is used for the joining and fixing of the components, this joining and fixing can be achieved with other methods such as welding and the like.

As shown in FIG. 6B, through-holes 42A for electrical wiring are formed in the portions of the spacer component 42 not overlapped by the long substrate 40. The electrical wiring, which is not shown, passes through the through-hole 42A and connects to the recording head unit 32 and a controller, also not shown.

Next, the manufacturing method for the inkjet recording head bar 30 of the present embodiment will be explained while referring to FIGS. 7A-7D.

Figure 7A:
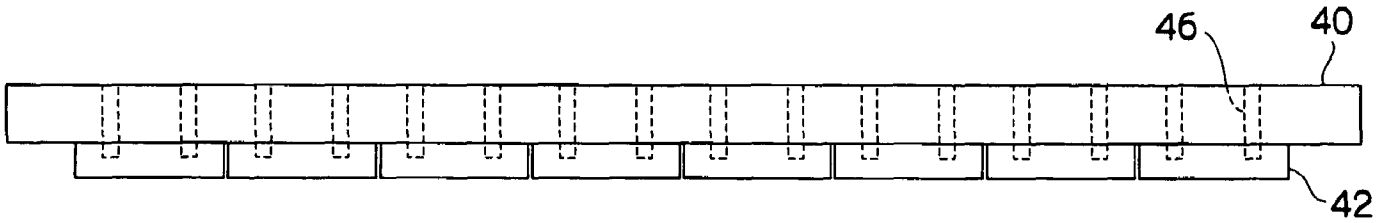
FIG. 7A-FIG. 7D are explanatory diagrams showing the processes of manufacturing the inkjet recording head bar of the present embodiment.

First, as shown in FIG. 7A, all of the spacer components 42 are attached to the long substrate 40. The attaching here involves screwing them together with screws 46.

Figure 7B:
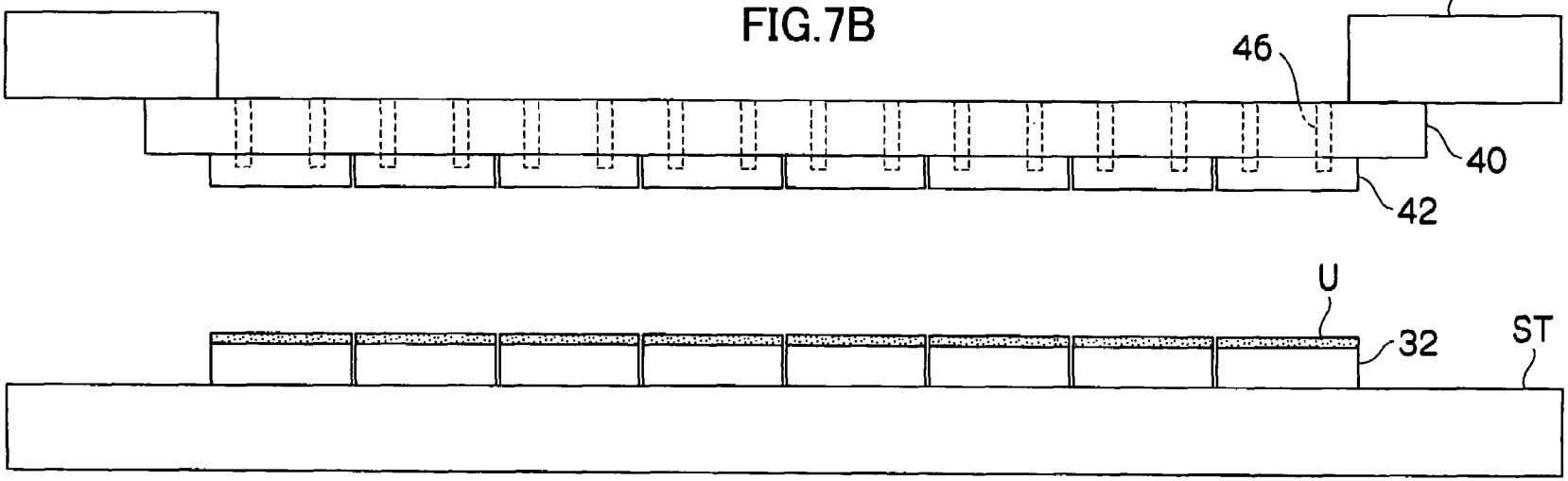

Next, as shown in FIG. 7B, the long substrate 40 is attached to a lowering arm SA used for joining. A line of recording head units 32, the number matching that necessary for forming one inkjet recording head bar 30, is lined on the thus attached long substrate 40 and a positioning stage ST arranged to be parallel. At this time, the positions of the nozzles 54 are precisely positioned and lined between each recording head unit 32. The adhesive U is coated along the edge portions in the longitudinal direction on the recording head unit 32.

Figure 7C:
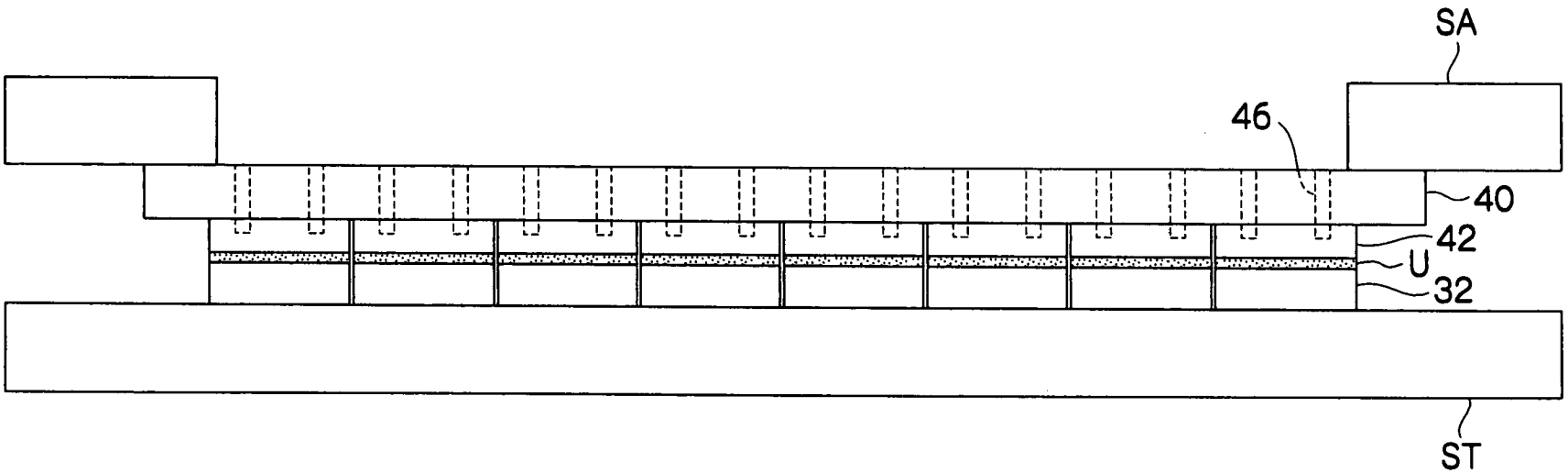

Next, as shown in FIG. 7C, the lowering arm SA used for joining is brought closer to the positioning stage ST while maintaining a level state and stopped at a position where the nozzle surface 52A form the preset nozzle surfaces. At this time, the adhesive U coated on the recording head unit 32 is pressed against the spacer component 42 and the thickness portions above a preset thickness are pressed down.

Figure 7D:
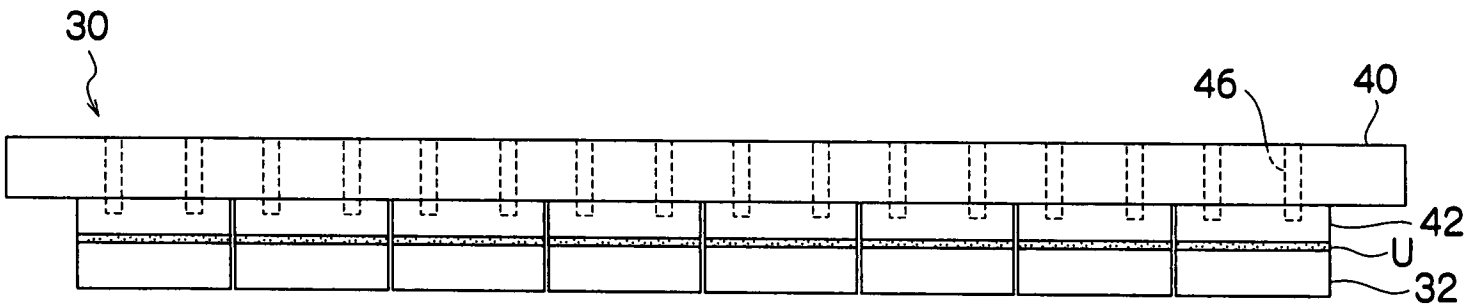

Next, curing processing is performed on the adhesive U with the above-described state of distance between the lowering arm SA used for joining and the positioning stage ST maintained as is. As shown in FIG. 7D, the lowering arm SA used for joining and the positioning stage ST are removed and the inkjet recording head bar 30 is thus completed.

With the above manufacturing method, the spacer component 42 is attached to the long substrate 40 with screw clamps. Nonetheless, this is attached to the long substrate 40 prior to the joining of the recording head unit 32 so slight position deviations of the spacer component 42 do not adversely affect the positioning of the recording head unit 32. Further, the recording head unit 32 is joined to the spacer component 42 in a state where the spacer component 42 is attached to the long substrate 40 using the adhesive U so joining can be performed in a state where it is aligned on the positioning stage ST so when compared to when screwing is performed, this can be joined with the precise position alignment as is.

Figure 8:
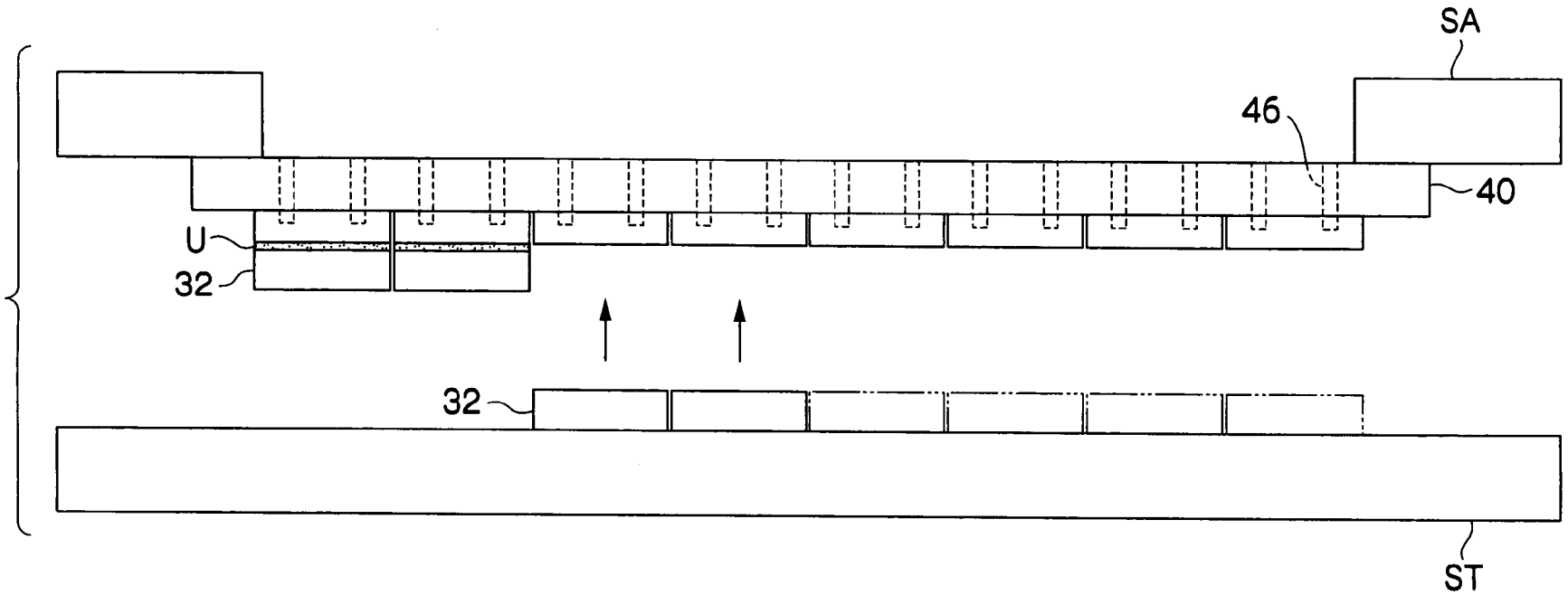
FIG. 8 is an explanatory diagram showing an alternative example to the process of manufacturing the inkjet recording head bar of the present embodiment.

It should be noted that with the above manufacturing method, all of the recording head units 32 necessary for forming the long substrate 40 were lined up and joined all at once, however, it is not absolutely necessary to join the recording head units 32 all at once. For example, as shown in FIG. 8A, sets of only one, two, etc. of the recording head units 32 can be lined up and joined, and the inkjet recording head bar 30 can be completed repeating the same process multiple times (in the example shown in FIG. 8A, these are attached two at a time).

Next, the operation of the inkjet recording device 10 of the present embodiment will be explained.

When an electric signal instructing to print is sent to the inkjet recording device 10, one sheet of recording paper P is picked up from the stocker 24 and conveyed to the recording unit 20 with the conveying device 26.

Meanwhile, at the inkjet recording head bar 30, ink is already injected (i.e., filled) into the individual channels of the recording head unit 32 from an ink tank through an ink supply port 92. At this time, a slightly indented meniscus forms at the ends (i.e., the eject openings) of the nozzles 54.

The recording paper P is conveyed at a preset conveying speed while ink droplets are selectively ejected from the multiple nozzles 54 of the recording head units 32 whereby, based on image data, an image is recorded on the recording paper P.

Figure 9:
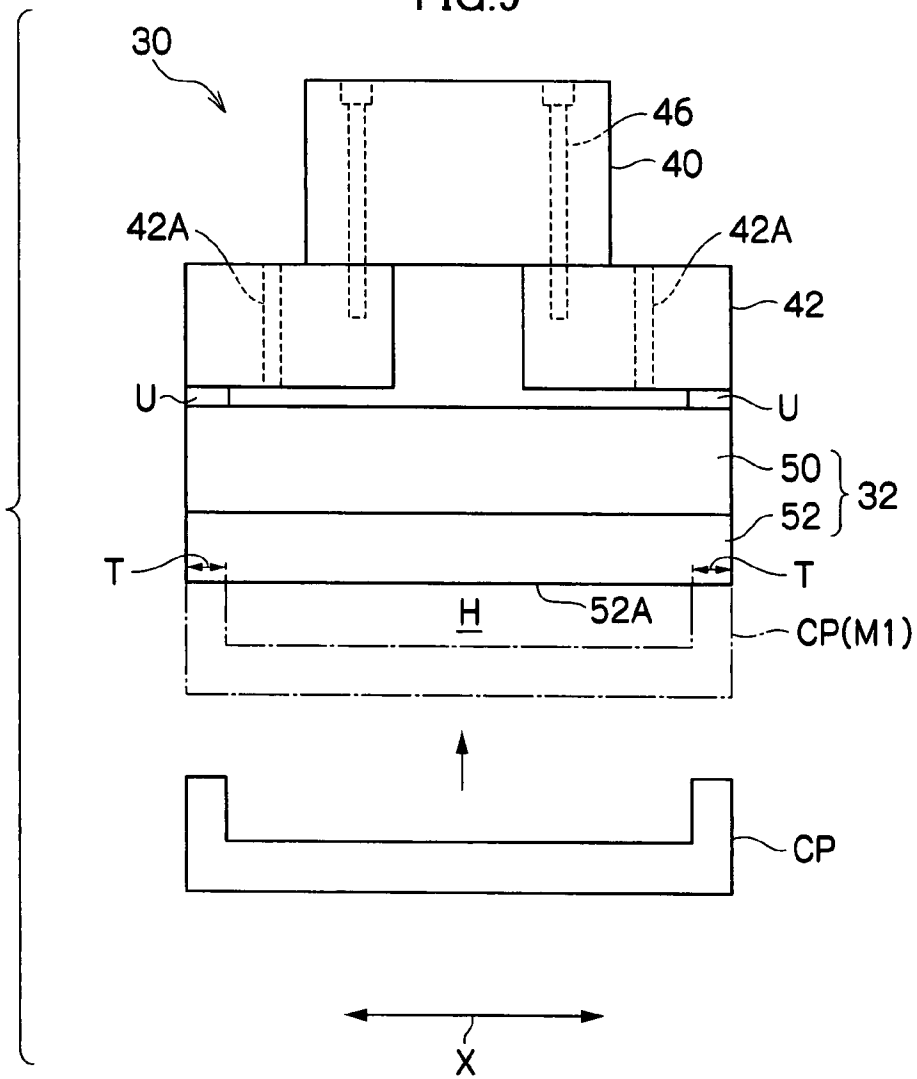
FIG. 9 is a diagram showing the position relations with a cap during maintenance of the inkjet recording head bar of the present embodiment.

As shown in FIG. 9, when maintenance of the recording head unit 32 is performed, a cap CP is arranged at a maintenance position MI and the recording head unit 32 is capped with the cap CP. At this time, the cap CP is pressed against the edge side portions T along the longitudinal direction of the recording head unit 32 (i.e., the same direction of the paper widthwise direction Y). Due to this, the side of the nozzle surface 52A of the inkjet recording head bar 30 is covered by the cap CP, whereby a sealed space H is formed. In this state, a pump (not shown) of the maintenance device 21 is operated and the sealed space H is negatively pressurized and the nozzles 54 are suctioned, whereby ink clots and the like clogging the nozzles 54 can be made to eject.

With the inkjet recording head bar 30 of the present embodiment, the joining of the spacer component 42 and the recording head unit 32 is performed at the edge side portions T pressed by the cap C at the time of the above-described maintenance so the joined portions can receive an appropriate amount of force acting upon it due to the pressing, so deformation of the inkjet recording head bar 30 and the like can be prevented.

Figure 10:
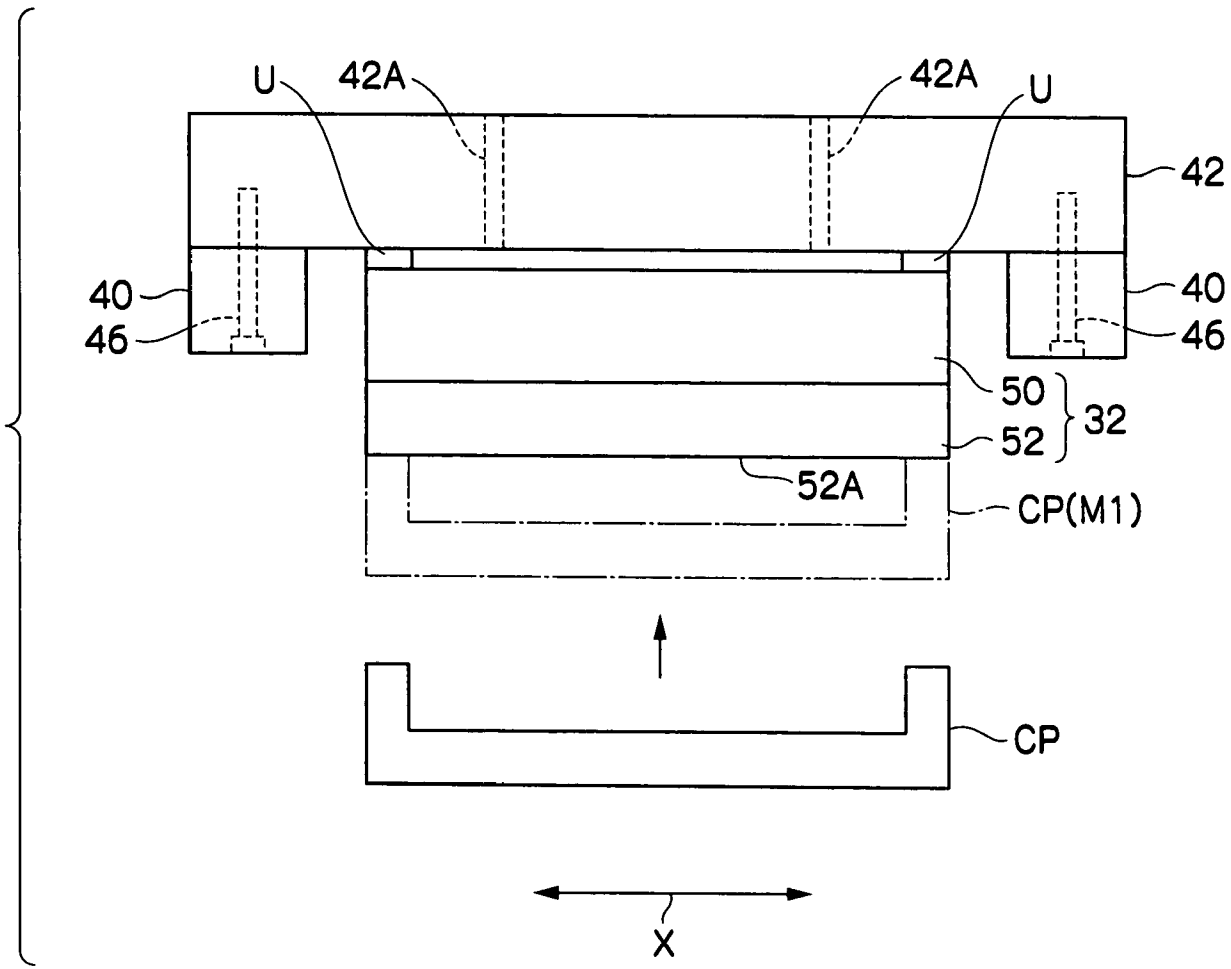
FIG. 10 is a diagram showing the position relations with a cap during maintenance of an inkjet recording head bar of another embodiment applied to the present invention.

Further, as shown in FIG. 10, both the long substrate 40 and recording head unit 32 can be arranged at the bottom side of the spacer component 42, however, with the arrangement of the present embodiment, both the long substrate 40 and the spacer component 42 can be made to receive the pressing force of the cap CP at the time of maintenance. Due to this, the strength of the components can be improved.

Figure 11:
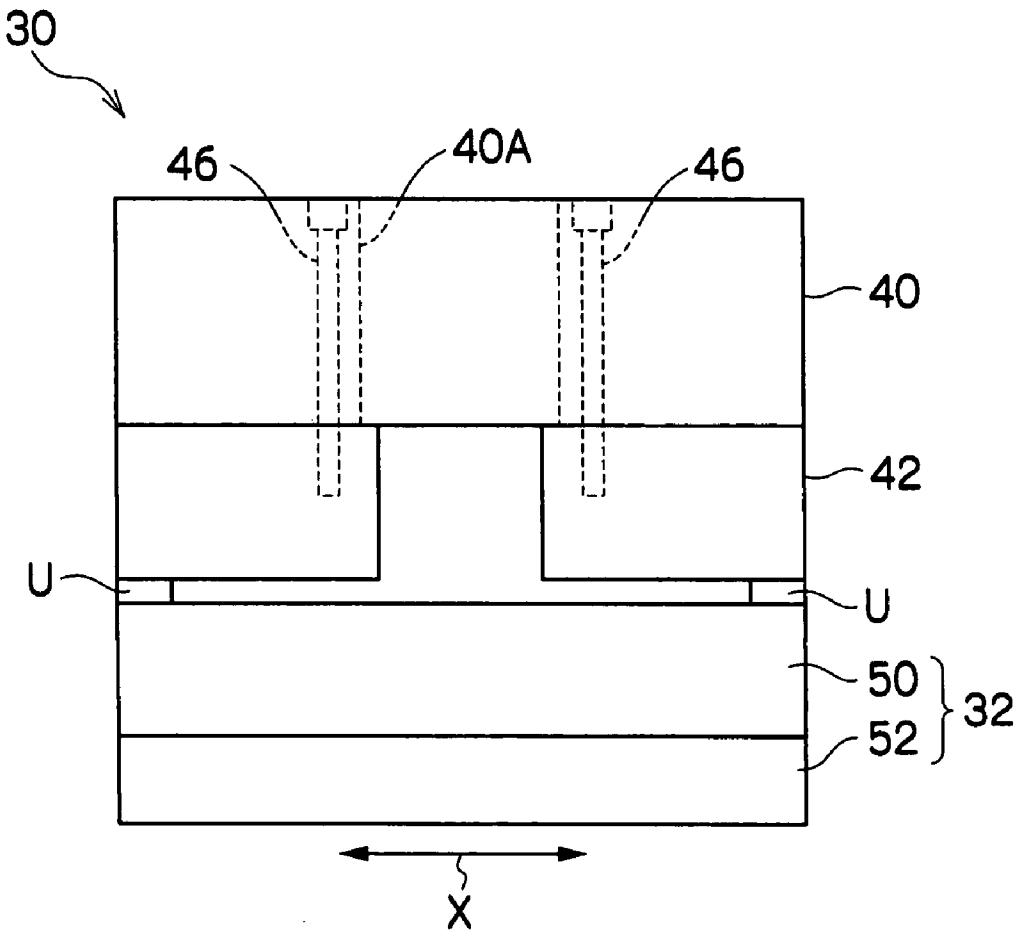
FIG. 11 is a side surface diagram showing an alternative example of the inkjet recording head bar of the present embodiment.

Further, in the present embodiment, the width of the paper sending direction of the long substrate 40 was made to be narrower than the width of the recording head unit 32, however, as shown in FIG. 11, this width can be made to be the same as the width of the recording head unit 32. In this case, the through-holes 42A for the electrical wiring are unnecessary, and electrical wiring can be placed at a position between the spacer components 42 communicated with the openings 40A of the long substrate 40.

Figure 12B:
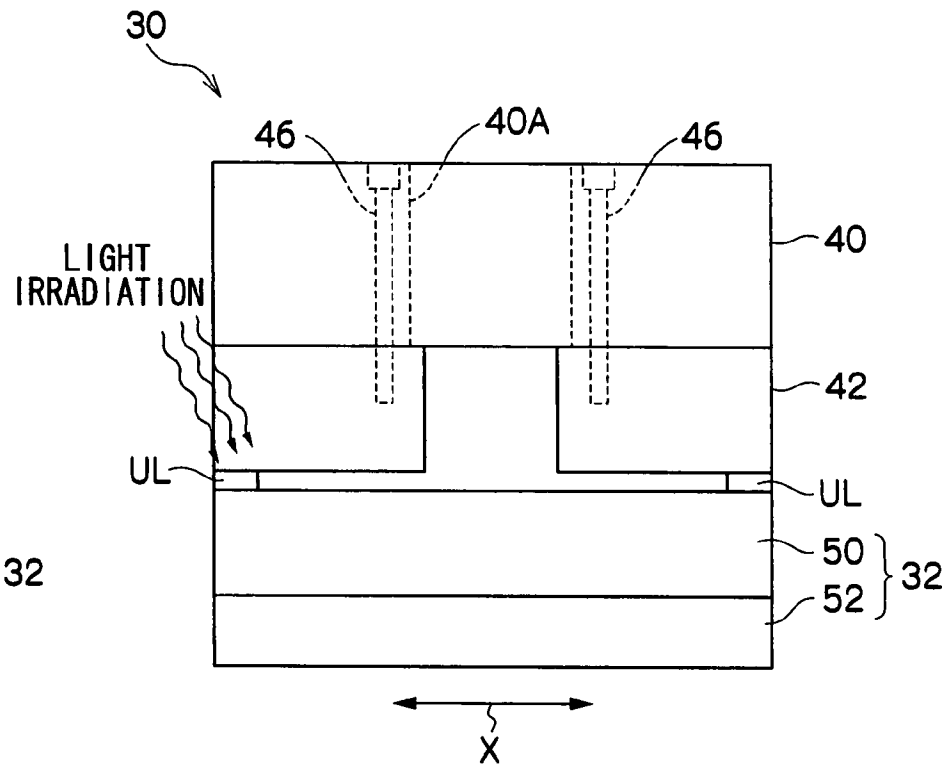
FIG. 12B is a side surface diagram showing yet another alternative example of the inkjet recording head bar of the present embodiment.
Figure 12A:
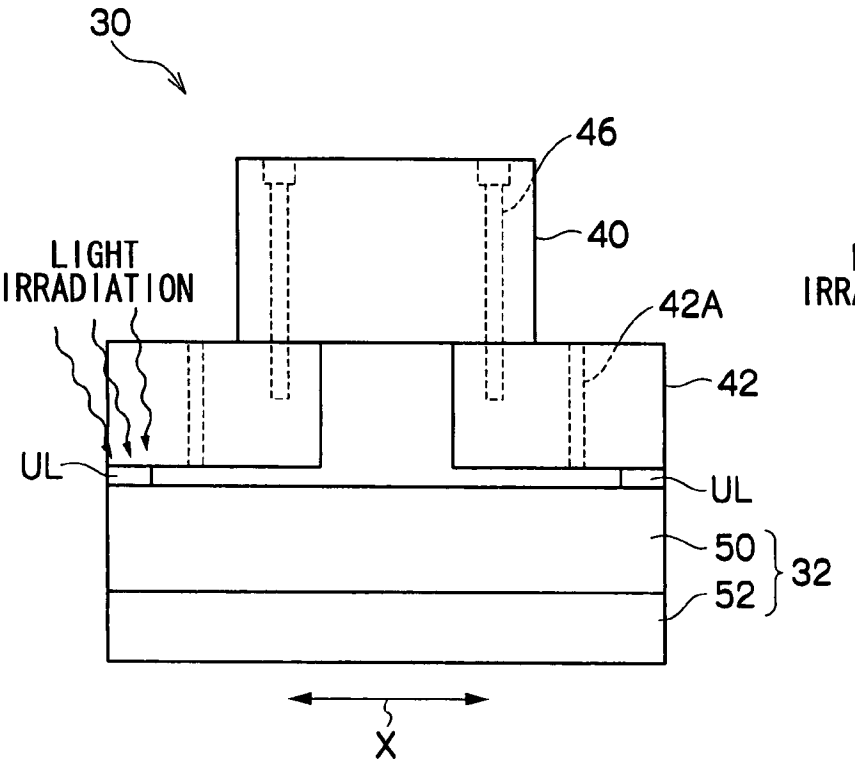
FIG. 12A is a side surface diagram showing yet another alternative example of the inkjet recording head bar of the present embodiment.

Further, the spacer component 42 can be formed from a transparent resin. If a transparent resin is used, productivity can be improved by using a light-curing type adhesive UL, as shown in FIGS. 12A and 12B. It should be noted that in this case, the light irradiation region can be widened and the irradiation efficiency improved by structuring, as shown in FIG. 12A, such that the width of the paper sending direction of the long substrate 40 is made narrower than the width of the recording head unit 32, as opposed to structuring as shown in FIG. 12B, where the width of the paper sending direction of the long substrate 40 is the same as the width of the recording head unit 32.

In the above-described present embodiment, explanations were made regarding an example where at least four inkjet recording head bars 30 corresponding to each color of YMCK, however, the inkjet recording heads of the present invention are not thus limited.

Figure 15:
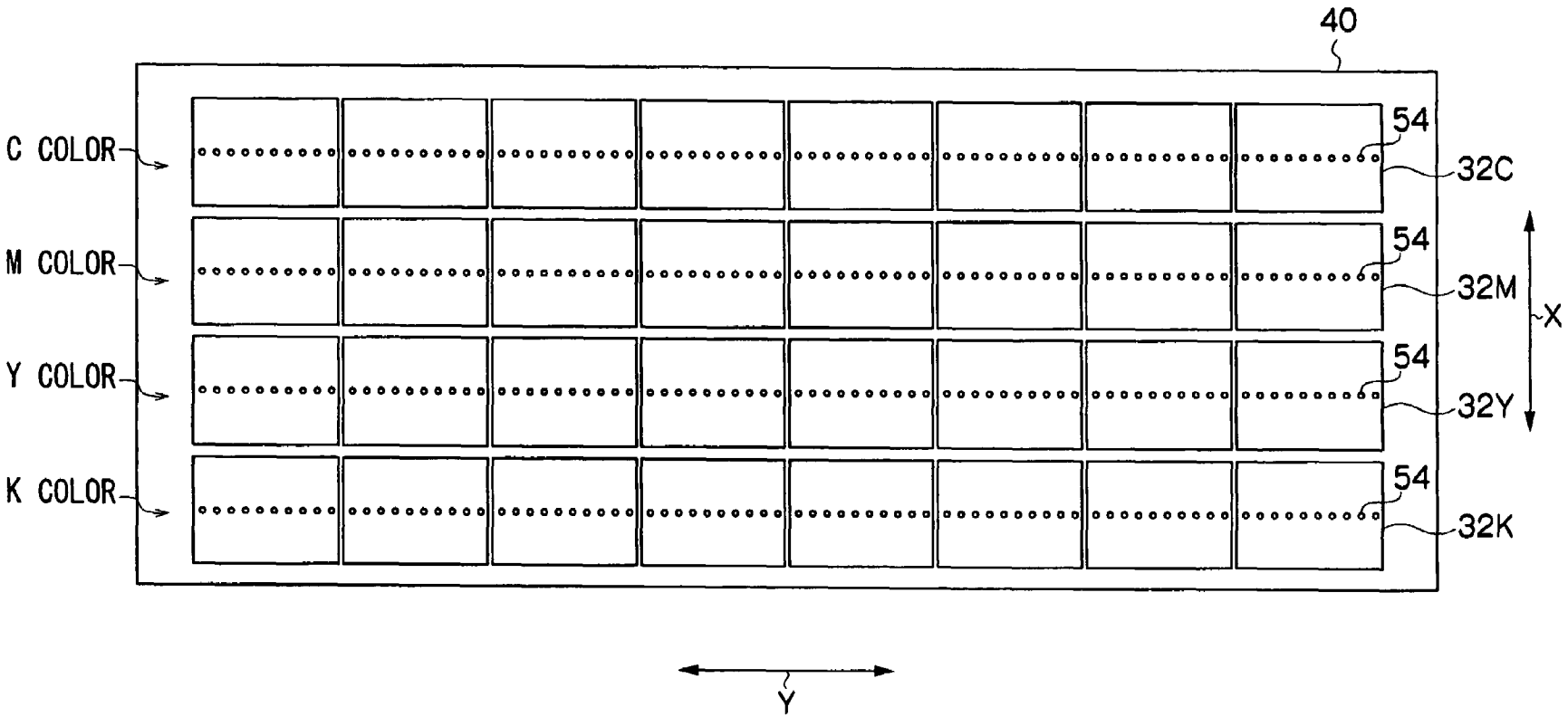
FIG. 15 is a diagram showing alternative examples of the long component and recording head unit arrangement of the inkjet recording head bar of the present embodiment.

For example, multiple recording head units 32 arranged two-dimensionally in the paper widthwise direction Y and the paper sending direction X can be set per long substrate 40. That is, recording head units 32C, 32M, 32Y, 32K corresponding to each color of YMCK for each line of multiple recording head units arranged in the paper widthwise direction Y (see FIG. 15).

Further, with the present embodiment, an example was explained of an FWA of paper width correspondence, however, the inkjet recording head of the present invention is not limited thereto. The present invention can also be applied to a partial width array (PWA) device that has a main scanning mechanism and a sub-scanning mechanism. Since the present invention is particularly effective at realizing highly dense nozzle arrangements, it is quite suitable for FWA, which requires 1-pass printing.

Furthermore, the inkjet recording device 10 of the above-described embodiment was made such that an inkjet recording head bar 30 for each of the colors black, yellow, magenta, and cyan, were mounted on a carriage 12, and recording was performed by selectively ejecting ink droplets from each color of inkjet recording head 32, whereby a full-color image was recorded on the recording paper P based on image data. Nonetheless, the inkjet recording in the present invention is not limited to recording characters and images on a recording paper P.

In other words, the recording medium is not limited to paper and the ejected liquid is not limited to ink. The liquid droplet ejecting head bar of the present invention can be applied to, for example, general liquid-ejecting (i.e., spraying) devices used industrially, such as those used when ejecting ink onto polymer films and glass when making color filters for displays, or for when ejecting solder in a molten state on a substrate when forming bumps for mounting parts.

In the present embodiment, the explanations involved an example corresponding to FWA paper width, however, the inkjet recording head bar of the present invention is not limited thereto and can be applied to PWA devices as well.

As explained above, the liquid droplet ejecting head bar of the present invention comprises: a plurality of liquid droplet ejecting head units that eject droplets from nozzles; a long substrate on which the plurality of liquid droplet ejecting head units are arranged; spacer components to which the liquid droplet ejecting head units are joined and fixed and which are attached to the long substrate so as to be removable.

The liquid droplet ejecting head bar of the present invention comprises multiple liquid droplet ejecting head units arranged on a long substrate. Spacer components are attached to the long substrate so as to be removable, and the liquid droplet ejecting head units are joined and fixed to the spacer components.

Since the spacer components can be removed from the long substrate, the liquid droplet ejecting head units can be removed making exchange of these units possible.

Further, with the present invention, the liquid droplet ejecting head units are joined and fixed to the spacer components so the liquid droplet ejecting head units and the spacer components are not easily separated. Nonetheless, when compared to when these are attached with an attaching means such as screw clamps, positioning with the adjoining liquid droplet ejecting head units becomes easier and these can thus be arranged with a high degree of accuracy.

It should be noted that the liquid droplet ejecting head bar of the present invention can be characterized in that multiple liquid droplet ejecting head units are arranged in a row in at least one direction of the long substrate and a liquid of the same material is ejected from the nozzles of the plurality of liquid droplet ejecting head units arranged in a row.

With this configuration, a liquid of the same material such as a liquid of the same color can be ejected from at least the same row of nozzles as one.

Further, the liquid droplet ejecting head bar of the present invention can be characterized in that the multiple liquid droplet ejecting head units are arranged in a row in the longitudinal direction of the long substrate and a liquid of the same material is ejected from the nozzles of the multiple liquid droplet ejecting head units arranged in a row.

With this configuration, a liquid of the same material such as a liquid of the same color can be ejected from at least the same row of nozzles in the longitudinal direction as one.

Further, the liquid droplet ejecting head bar of the present invention can be characterized in that the spacer components are provided for each of the liquid droplet ejecting head units.

With the above configuration, the spacer components can be separated from the long substrate, whereby the individual liquid droplet ejecting head units can be removed from the long substrate. For this reason, exchange of each of the liquid droplet ejecting head units can be performed.

Further, the liquid droplet ejecting head bar of the present invention can be characterized in that the spacer components are attached with screws to the long substrate.

In this manner, the spacer components can be attached so as to be removable from the long substrate due to the screws.

Further, the liquid droplet ejecting head bar of the present invention can be characterized in that the liquid droplet ejecting head units are joined and fixed to the spacer components with adhesive or welding.

In this manner, the liquid droplet ejecting head units can be joined and fixed to the spacer components with adhesive or welding.

Further, the liquid droplet ejecting head bar of the present invention can be characterized in that a liquid supplying route that supplies liquid to the liquid droplet ejecting head unit from the side of the long substrate is formed by a liquid supply route space that can be arranged due to the spacer component.

With the present invention, the liquid supply route space is formed by the spacer components so this space is used so that a liquid supplying route for supplying liquid to the liquid droplet ejecting head units from the side of the long substrate can be arranged.

Further, the liquid droplet ejecting head bar of the present invention can be characterized in that the liquid droplet ejecting head units are provided with a liquid relaying portion formed from the individual supply routes communicated with each of the plurality of nozzles.

The liquid droplet ejecting head unit and the liquid droplet ejecting device can be made more compact by positioning the liquid relay units closer to the individual nozzles.

Further, the liquid droplet ejecting head bar of the present invention can be characterized in that a gap is formed between the liquid droplet ejecting head units and the spacer components.

When the long liquid droplet ejecting head bar is configured such that multiple liquid droplet ejecting head units are lined thereon, the individual liquid droplet ejecting head units have variations in thickness due to the thicknesses of each of the components and unevenness at the surface so there are cases where the nozzle surface of the liquid droplet ejecting bar is not even. Here, as described above, a gap is formed between the liquid droplet ejecting head units and the spacer components. The liquid droplet ejecting head units can be joined and fixed such that the nozzle surface is made even by adjusting the size of this gap.

Further, the liquid droplet ejecting head bar of the present invention can be characterized in that the spacer components are arranged between the liquid droplet ejecting head units and the long substrate.

In this manner, by stacking the long substrate, the spacer components, and the liquid droplet ejecting units in this order, the pressing force applied to the liquid droplet ejecting head units when performing maintenance on the nozzles can be received by both the spacer components and the long substrate.

Further, the liquid droplet ejecting head bar of the present invention can be characterized in that the spacer components and the individual liquid droplet ejecting head units are joined at positions along the edge sides of the longitudinal direction of the liquid droplet ejecting head units.

When performing maintenance such as suction and the like on the nozzles of the liquid droplet ejecting head units, the maintenance unit adheres closely to the liquid droplet ejecting head units and pressing force acts thereon. Generally, the positions of this close adhesion are along the edge sides in the longitudinal direction of the liquid droplet ejecting head units and it is necessary to receive or absorb the pressing force at these positions. With the present invention, the spacer components and the individual—liquid droplet ejecting heads are joined at these positions so the configuration is one that can withstand this pressing force.

Further, the liquid droplet ejecting head bar of the present invention can be characterized in that the spacer components are formed from transparent resin.

By making the spacer components from a transparent resin, a light-curing type adhesive can be used as a joining and fixing means for the liquid droplet ejecting head units and the spacer components.

The liquid droplet ejecting device can be provided with the liquid droplet ejecting head bar described above.

With the liquid droplet ejecting device described above, the liquid droplet ejecting head units can be separated from the long substrate so these can be exchanged. Accordingly, when (a) liquid droplet ejecting head unit(s) breaks or malfunctions, it is not necessary to replace the entire liquid droplet ejecting head bar of the long substrate. This has advantages, for example, for users, who can reduce the maintenance costs of their printing device. Further, in the inspection process during manufacturing, even if a faulty liquid droplet ejecting head unit within the liquid droplet ejecting head bar is detected, this can be exchanged, whereby manufacturing costs can also be reduced.

With the liquid droplet ejecting head bar manufacturing method of the present invention, the spacer components are attached to the long substrate so as to be removable. With this method, the liquid droplet ejecting head units that eject liquid droplets from nozzles are positioned and joined with the spacer components.

Since highly precise positioning is necessary for the liquid droplet ejecting head units, it is difficult to attach these with screws. However, it is not necessary to position the spacer components with the same degree of precision so even if there are slight deviations at the time of attachment to the long substrate, this is permissible, especially with deviations in the surface direction. With the liquid droplet ejecting head bar manufacturing method of the present invention, the spacer components are first attached to the long substrate so as to be removable, after which the liquid droplet ejecting head units are positioned and joined with the spacer components. By manufacturing with this process, exchange of each of the individual liquid droplet ejecting head units and highly precise joining of the components can be achieved.

As described above, with the present invention, each of the liquid droplet ejecting head units can be exchanged and further, positioning between the liquid droplet ejecting head units can be performed with a high degree of precision.

What is claimed is:

1. A liquid droplet ejecting head bar comprising:

a plurality of liquid droplet ejecting head units that eject liquid droplets from nozzles;

a long substrate on which the plurality of liquid droplet ejecting head units are arranged;

spacer components to which the liquid droplet ejecting head units are joined and fixed and which are attached to the long substrate so as to be removable;

the spacer components being arranged two each per liquid droplet ejecting head unit so as to be separated from each other in a paper sending direction; and an ink supplying unit arranged between two spacer components so as to supply ink from an ink tank to the liquid droplet ejecting head unit.

2. The liquid droplet ejecting head bar of claim 1, wherein the plurality of liquid droplet ejecting head units are arranged in a row in at least one direction of the long substrate and a liquid of the same material is ejected from the nozzles of the plurality of liquid droplet ejecting head units arranged in a row.

3. The liquid droplet ejecting head bar of claim 2, wherein the plurality of liquid droplet ejecting head units are arranged in a row in the longitudinal direction of the long substrate and a liquid of the same material is ejected from the nozzles of the plurality of liquid droplet ejecting head units arranged in a row.

4. The liquid droplet ejecting head bar of claim 1, wherein the spacer components are provided for each of the liquid droplet ejecting head units.

5. The liquid droplet ejecting head bar of claim 1, wherein the spacer components are attached with screws to the long substrate.

6. The liquid droplet ejecting head bar of claim 1, wherein the liquid droplet ejecting head units are joined and fixed to the spacer components with adhesive or welding.

7. The liquid droplet ejecting head bar of claim 5, wherein the liquid droplet ejecting head units are joined and fixed to the spacer components with adhesive or welding.

8. The liquid droplet ejecting head bar of claim 1, wherein a liquid supplying route that supplies liquid to the liquid droplet ejecting head unit from the side of the long substrate is formed by a liquid supply route space that can be arranged due to the spacer component.

9. The liquid droplet ejecting head bar of claim 1, wherein the liquid droplet ejecting head units are provided with a liquid relaying portion formed from the individual supply routes communicated with each of the plurality of nozzles.

10. The liquid droplet ejecting head bar of claim 1, wherein a gap is formed between the liquid droplet ejecting head unit and the spacer components.

11. The liquid droplet ejecting head bar of claim 1, wherein the spacer components are arranged between the liquid droplet ejecting head units and the long substrate.

12. The liquid droplet ejecting head bar of claim 1, wherein the spacer components and the individual liquid droplet ejecting head units are joined at positions along the edge sides of the longitudinal direction of the liquid droplet ejecting head units.

13. The liquid droplet ejecting head bar of claim 1, wherein the spacer components are formed from transparent resin.

14. A liquid droplet ejecting device having a liquid droplet ejecting head bar comprising:

a plurality of liquid droplet ejecting head units that eject liquid droplets from nozzles;

a long substrate on which the plurality of liquid droplet ejecting head units are arranged;

spacer components to which the liquid droplet ejecting head units are joined and fixed and which are attached to the long substrate so as to be removable;

the spacer components being arranged two each per liquid droplet ejecting head unit so as to be separated from each other in a paper sending direction; and an ink supplying unit arranged between two spacer components so as to supply ink from an ink tank to the liquid droplet ejecting head unit.

* * * * *